US005876192A

United States Patent [19]

Follmer

[11] Patent Number: 5,876,192

[45] Date of Patent: Mar. 2, 1999

[54] DIFFERENTIAL EXPANSION CONTROL ASSEMBLY FOR A PUMP

[75] Inventor: William Calvin Follmer, Livonia, Mich.

[73] Assignee: Ford Global Technologies, Inc., Dearborn, Mich.

[21] Appl. No.: 744,914

[22] Filed: Nov. 8, 1996

[51] Int. Cl.[6] ..... F04C 2/344; F04C 15/00

[52] U.S. Cl. ..... 418/149; 418/178; 418/179

[58] Field of Search ..... 418/83, 149, 178, 418/179

[56] References Cited

U.S. PATENT DOCUMENTS

| | | | |
|---|---|---|---|
| 2,312,655 | 3/1943 | Lauck | 418/179 |
| 2,816,702 | 12/1957 | Woodcock | 418/179 |
| 3,923,432 | 12/1975 | Nakakobara | 418/179 |
| 4,128,366 | 12/1978 | Sone | 418/179 |
| 4,514,155 | 4/1985 | Ogawa | 418/149 |

FOREIGN PATENT DOCUMENTS

| | | | |
|---|---|---|---|
| 3620190 | 12/1987 | Germany | 418/179 |
| 3620205 | 12/1987 | Germany | 418/179 |
| 57-148095 | 9/1982 | Japan | 418/178 |
| 62-111187 | 5/1987 | Japan | 418/179 |
| 62-150094 | 7/1987 | Japan | 418/179 |
| 5-126075 | 5/1993 | Japan | 418/179 |

OTHER PUBLICATIONS

Philip Gustave Laurson & William Junkin Cox, Stress Due to Axial Loads, pp. 80–83, 1954.

G. Pahl & W. Beitz, Engineering Design A Systematic Approach, pp. 229,241, 1988.

L. Bruni, R. Casellato, P. Matteoda, and R. Ongetta, The "X" Piston — 5 Years Later, pp. 547–554. SAE Technical Series No. 910799.

Ronald P. Dickerhoff, Harold E. Hil, and Gary E. Kreider, Thermal Compensating Tapered Roller Bearing for Enhancement of Transmission and Transaxle Performance, 1991, 97–105. (SAE Technical Papers No. 905189).

*Primary Examiner*—John J. Vrablik

*Attorney, Agent, or Firm*—Frank G. McKenzie, Esq.; Roger L. May, Esq.

[57] ABSTRACT

A differential expansion control assembly is provided for a pump. The pump has a pump body with a base portion and cover portion of a first material with a first thermal expansion coefficient and a pumping mechanism of a second material with a second thermal expansion coefficient different from the first thermal expansion coefficient. The differential expansion control assembly includes at least one member disposed between the base portion and cover portion to negate a difference between the first thermal expansion coefficient and the second thermal expansion coefficient and maintain a relative controlled clearance between the cover portion and the pumping mechanism. The differential expansion control assembly also includes a seal disposed between the cover portion and base portion to allow for differential expansion of the pump body without leakage of fluid between the cover portion and base portion.

19 Claims, 2 Drawing Sheets

DIFFERENTIAL EXPANSION CONTROL ASSEMBLY FOR A PUMP

BACKGROUND OF THE INVENTION

1. Field of the Invention

The present invention relates generally to pumps and, more specifically, to a differential expansion control assembly for a pump in a transmission of a motor vehicle.

2. Description of the Related Art

It is known to provide a pump for a transmission in a motor vehicle. The pump may be of a variable or fixed displacement type. The pump generally includes a pump body and a pumping mechanism. Commonly, the pump body is made of an aluminum material because of its light weight and the pumping mechanism is made of a steel material because of its wear and friction properties.

It is also known that the thermal expansion coefficient for aluminum is greater than the thermal expansion coefficient for steel. As a result, the pump body expands more than the pumping mechanism as temperature increases, in turn, increasing internal clearances of the pump. Since the pump is designed to resist seizing at low temperatures (−40° F.), additional clearance results at higher temperatures due to the differential expansion. As leakage is generally proportional to the cube of the clearance, this additional clearance is responsible for a large increase in pump leakage at normal operating temperatures (150° to 250° F.).

SUMMARY OF THE INVENTION

Accordingly, the present invention is a differential expansion control assembly for a pump. The pump has a pump body with a base portion and a cover portion of a first material with a first thermal expansion coefficient and a pumping mechanism of a second material with a second thermal expansion coefficient different from the first thermal expansion coefficient. The differential expansion control assembly comprises at least one member disposed between the base portion and cover portion to negate a difference between the first thermal expansion coefficient and the second thermal expansion coefficient and maintain a nearly constant or controlled relative clearance between the cover portion and the pumping mechanism. The differential expansion control assembly also includes a seal disposed between the base portion and cover portion to allow for differential expansion of the pump body without leakage of fluid between the cover portion and base portion.

One feature of the present invention is that a differential expansion control assembly is provided for a pump. Another feature of the present invention is that the differential expansion control assembly matches thermal expansion coefficients for components that control critical dimensions and controls the additional clearance, thereby improving pump efficiency and reducing internal leakage. Yet another feature of the present invention is that the differential expansion control assembly allows the continued use of aluminum for the pump body without the penalty of increased clearances.

Other features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
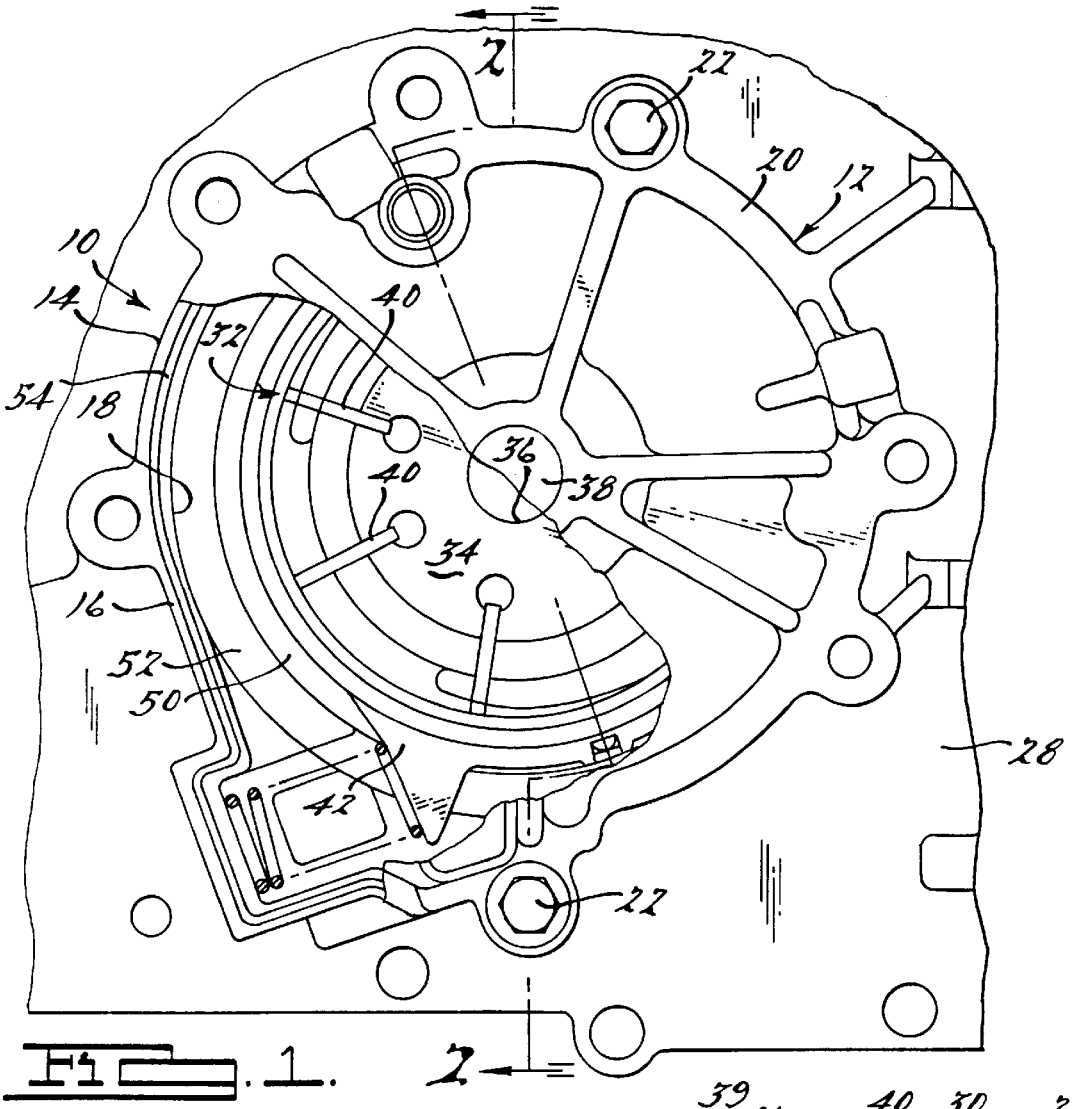
FIG. 1 is a top view of a differential expansion control assembly for a pump in a transmission according to the present invention.
Figure 2:
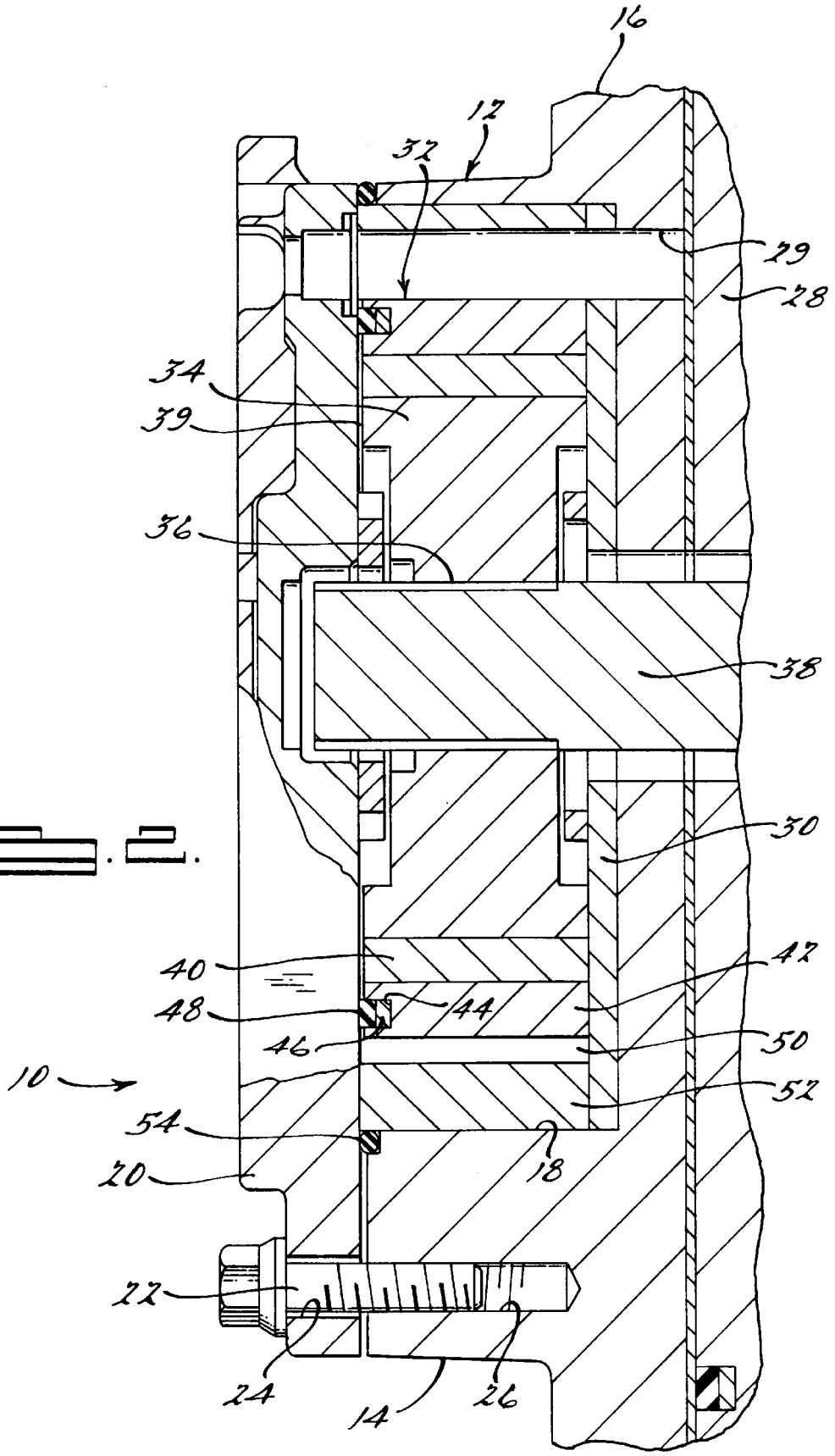
FIG. 2 is a sectional view taken along line 2—2 of FIG. 1.

Referring to the drawings and in particularly to FIGS. 1 and 2, one embodiment of a differential expansion control assembly 10, according to the present invention, is shown for a pump 12 of a transmission (not shown) of a motor vehicle (not shown). The pump 12 is of a variable displacement type for pumping a fluid such as oil in the transmission. It should be appreciated that other types of pumps may be used for the transmission.

The pump 12 includes a pump body 14 having a base portion 16 with a cavity 18 at one end. The cavity 18 is generally circular in shape. The pump body 14 also includes a cover portion 20 to close the opening of the cavity 18. The cover portion 20 is generally circular in shape. The cover portion 20 is removably secured to the base portion 16 by suitable means such as fasteners 22 passing through apertures 24 in the cover portion 20 and threadably engaging threaded bores 26 in the base portion 16. The pump body 14 is removably secured to transmission structure such as a valve body 28 by suitable means such as fasteners (not shown) passing through apertures 29 in the pump body 14 and threadably engaging threaded bores (not shown) in the valve body 28. The pump body 14 is made of a light weight material such as aluminum having a first thermal expansion coefficient of 13 E-6/° F. It should be appreciated that the fasteners 22 may be the same or a different material from the pump body 14.

The pump 12 includes a wear plate 30 disposed within the cavity 18 adjacent a wall of the base portion 16. The wear plate 30 is generally circular in shape and made of a ferrous material such as steel. It should be appreciated that the valve body 28 and wear plate 30 have an aperture to allow a shaft 38 to extend therethrough.

The pump 12 also includes a pumping mechanism, generally indicated at 32, disposed within the cavity 18 and adjacent the wear plate 30. The pumping mechanism 32 includes a rotor 34 disposed about and splined at 36 to a rotatable shaft 38. The rotor 34 is generally circular in shape and made of a ferrous material such as steel. The rotor 34 includes a plurality of vanes 40 extending radially and disposed circumferentially thereabout. The vanes 40 are made of a ferrous material such as steel. The rotor 34 and vanes 40 contact the wear plate 30 and are spaced a predetermined amount from the cover portion 20 to form a gap or clearance 39 therebetween. It should be appreciated that the shaft 38 extends through an aperture in the rotor 34.

The pumping mechanism 32 also includes a bore ring 42 disposed about the vanes 40. The bore ring 42 is generally circular in shape and made of a ferrous material such as steel. The bore ring 42 contacts the wear plate 30 and is spaced from the cover portion 20 by the clearance 39. The bore ring 42 includes a groove 44 circumferentially thereabout and extending axially therein. The bore ring 42 includes a seal ring 46 and flexible seal 48 disposed in the groove 44. The seal ring 46 is made of a ferrous material such as steel and the flexible seal 48 is an O-ring made of an elastomeric material. The flexible seal 48 is disposed between the seal ring 46 and cover portion 20 of the pump body 14 to seal a chamber 50. The rotor 34, vanes 40 and bore ring 42 have a second thermal expansion coefficient such as 9 E-6/° F. It should be appreciated that, up to this point in the description, the pump 12 is conventional and known in the art.

Figure 3:
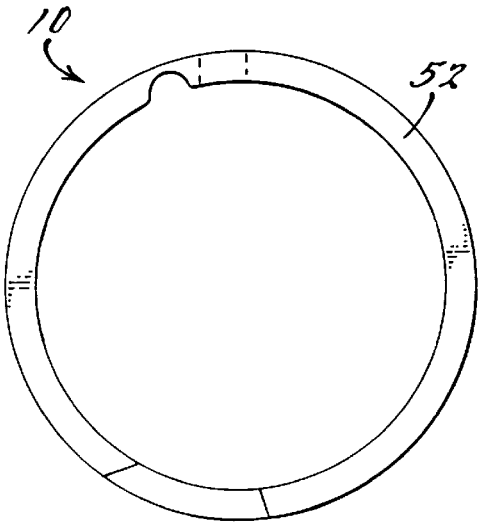
FIG. 3 is a top view of a member of the differential expansion control assembly of FIG. 1.

Referring to FIGS. 2 and 3, the differential expansion control assembly 10, according to the present invention, is disposed in the cavity 18 and about the pumping mechanism 32 to define a control volume or chamber 50 therebetween. The differential expansion control assembly 10 includes at least one differential expansion control member 52 such as a ring made of a ferrous material such as steel. The differential expansion control member 52 extends axially to contact both the wear plate 30 and cover portion 20. The differential expansion control member 52 has a thermal expansion coefficient approximately equal to the thermal expansion coefficient of the pumping mechanism 32 such as 9 E-6/° F.

The differential expansion control assembly 10 also includes a complaint seal 54 such as a gasket or O-ring disposed between the cover portion 20 and base portion 16 to take up the differential expansion of the pump body 14. It should be appreciated that the complaint seal 54, which allows for differential expansion, closes the clearance 39 between the cover portion 20 and base portion 16.

In operation, the pump 12 is heated by the fluid through the pump 12. As the pump 12 increases in temperature, the pump body 14 expands more than the pumping mechanism 32 due to their respective thermal expansion coefficients. The differential expansion control member 52 expands the same amount as the pumping mechanism 32. As a result, the cover portion 20 maintains the same clearance 39 relative to the pumping mechanism 32 as when the pump 12 is cold. The complaint seal 54 resists leakage of the heated fluid between the cover member 20 and base portion 16 of the pump body 14.

Figure 4:
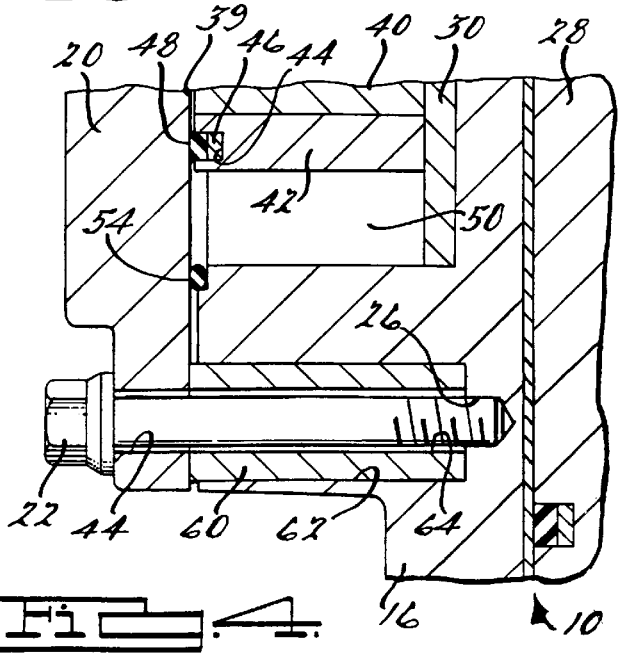
FIG. 4 is a partial fragmentary view of another embodiment, according to the present invention, of the differential expansion control assembly of FIG. 1.

In another embodiment illustrated in FIG. 4, the differential expansion control assembly 10 may be differential expansion control spacers or posts 60 disposed about the fasteners 22 and in a bore 62 in the base portion 16 of the pump body 14. The differential expansion control spacers 60 extend to the same depth as the wear plate 30 for equal expansion length. The differential expansion control spacers 60 are generally cylindrical in shape with an aperture 64 extending therethrough. The differential expansion control spacers 60 are made of a ferrous material such as steel. The differential expansion control spacers 60 have a thermal expansion coefficient approximately equal to the thermal expansion coefficient of the pumping mechanism 32 such as 9 E-6/° F. The length or material of the spacers 60 may be changed to control the amount of clearance 39 required. The differential expansion control assembly 10 also includes the complaint seal 54 to seal the cover member 20 to the base portion 16. It should be appreciated that the fasteners 22 extend through the aperture 62 and threadably engage the threaded aperture 26. It should also be appreciated that the differential expansion control spacers 60 position the cover portion 20 relative to the pumping mechanism 32. It should further be appreciated that there is no relative differential expansion between the cover portion 20 and pumping mechanism 32 if materials and dimensions are used to provide exact compensation. It should be appreciated that the seal 54 has the necessary compliance to allow for the expansion of the pump body 14 without forcing the cover member 20 to lift or the seal 54 to leak.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A differential expansion control assembly for a pump, the pump having a pump body with a base portion and a cover portion made of a first material with a first thermal expansion coefficient and a pumping mechanism disposed within the pump body and made of a second material with a second thermal expansion coefficient different from the first thermal expansion coefficient, said differential expansion control assembly comprising:

at least one member disposed about the pumping mechanism and axially between the base portion and cover portion to contact the cover portion and to negate a difference between the first thermal expansion coefficient and the second thermal expansion coefficient and to maintain a relative controlled clearance between the cover portion and the pumping mechanism; and a seal disposed axially between and contacting the base portion and the cover portion to close the clearance between said cover portion and said base portion and to allow for differential expansion of the pump body without leakage of fluid between the cover portion and base portion.

2. A differential expansion control assembly as set forth in claim 1 wherein said member has a thermal expansion coefficient approximating said second thermal expansion coefficient.

3. A differential expansion control assembly as set forth in claim 1 wherein said member is a ring.

4. A differential expansion control assembly as set forth in claim 1 wherein said member is made of a ferrous material.

5. A differential expansion control assembly as set forth in claim 1 wherein said seal is made of a complaint material.

6. A pump comprising:

a pump body having a base portion and a cover portion made of a first material with a first thermal expansion coefficient;

a pumping mechanism disposed within said pump body and made of a second material with a second thermal expansion coefficient, said first thermal expansion coefficient being different from said second thermal expansion coefficient;

a differential expansion control member disposed about said pumping mechanism and axially between said base portion and said cover portion to contact said cover portion and to negate a difference between said first thermal expansion coefficient and said second thermal expansion coefficient and to maintain a relative controlled clearance between said cover portion and said pumping mechanism; and a seal disposed axially between and contacting said base portion and said cover portion to close the clearance between said cover portion and said base portion and to allow for differential expansion of said pump body without leakage of fluid between said cover portion and said base portion.

7. A pump as set forth in claim 6 wherein said base portion has a cavity and said cover portion closes an opening of said cavity.

8. A pump as set forth in claim 6 wherein said differential expansion control member is a ring.

9. A pump as set forth in claim 6 wherein said differential expansion control member has a thermal expansion coefficient approximately said second thermal expansion coefficient.

10. A pump as set forth in claim 6 wherein said pump body is made of an aluminum material.

11. A pump as set forth in claim 6 wherein said pumping mechanism and said differential expansion control member are made of a ferrous material.

12. A pump as set forth in claim 6 wherein said pumping mechanism is disposed in said cavity and spaced from said cover portion to form the relative clearance and said differential expansion control member is disposed in said cavity.

13. A pump as set forth in claim 6 wherein said pumping mechanism comprises a rotor having at least one vane and a bore ring disposed about said rotor and said at least one vane.

14. A pump as set forth in claim 6 including a wear plate disposed in said cavity between said pumping mechanism and said differential expansion control member and a wall of said base portion.

15. A pump as set forth in claim 14 wherein said wear plate is made of a ferrous material.

16. A pump as set forth in claim 6 wherein said seal is made of a complaint material.

17. A pump as set forth in claim 6 wherein said differential expansion control member is a spacer disposed between said cover portion and said base portion.

18. A pump as set forth in claim 17 wherein said differential expansion control member has a thermal expansion coefficient approximately said second thermal expansion coefficient.

19. A pump in a transmission comprising:

a pump body including a base portion having a cavity and a cover portion closing an opening of said cavity, said pump body being made of a first material with a first thermal expansion coefficient;

a pumping mechanism, including a rotor having at least one vane and a bore ring about said rotor and said at least one vane, disposed in said cavity and spaced from said cover portion to form a clearance therebetween, said pumping mechanism being made of a second material with a second thermal expansion coefficient, said first thermal expansion coefficient being different from said second thermal expansion coefficient; and a differential expansion control member disposed about said pumping mechanism in said base portion and axially between said base portion and said cover portion and contacting said cover portion to negate a difference between said first thermal expansion coefficient and said second thermal expansion coefficient and to maintain the clearance between said pump body and said pumping mechanism; and a seal disposed axially between and contacting said base portion and said cover portion to close the clearance between said cover portion and said base portion and to allow for differential expansion of said pump body without leakage of fluid between said base portion and said cover portion.

* * * * *